US009939778B2

(12) United States Patent
Kawakami et al.

(10) Patent No.: US 9,939,778 B2
(45) Date of Patent: Apr. 10, 2018

(54) CARTRIDGE AND COVER MEMBER

(71) Applicant: CANON KABUSHIKI KAISHA, Tokyo (JP)

(72) Inventors: Takuya Kawakami, Mishima (JP); Toru Oguma, Mishima (JP); Yohei Kusano, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/289,020

(22) Filed: Oct. 7, 2016

(65) Prior Publication Data

US 2017/0108824 A1 Apr. 20, 2017

(30) Foreign Application Priority Data

Oct. 14, 2015 (JP) ..... 2015-203146
Aug. 30, 2016 (JP) ..... 2016-168586

(51) Int. Cl.
*G03G 15/00* (2006.01)
*G03G 21/18* (2006.01)
*G03G 21/16* (2006.01)

(52) U.S. Cl.
CPC ..... *G03G 21/1814* (2013.01); *G03G 21/1633* (2013.01); *G03G 21/181* (2013.01)

(58) Field of Classification Search
CPC ..... G03G 21/163; G03G 21/181; G03G 21/1814; G03G 21/1863
See application file for complete search history.

(56) References Cited

U.S. PATENT DOCUMENTS 6,097,909 A * 8/2000 Watanabe ..... G03G 21/1853 399/111
2014/0270845 A1* 9/2014 Kawakami ..... G03G 21/186 399/110

FOREIGN PATENT DOCUMENTS

JP 2002-268519 A 9/2002
JP 4498407 B2 7/2010
JP 2013-54061 A 3/2013

* cited by examiner

*Primary Examiner* — Hoang Ngo
(74) *Attorney, Agent, or Firm* — Canon U.S.A., Inc., IP Division

(57) ABSTRACT

A cartridge includes a cover member that includes a flat portion, a substantially circular hole portion formed in the flat portion, an arc portion inserted through the hole portion, a first cutaway portion having a shape formed by cutting in the hole portion radially outward, the first cutaway portion arranged in a position opposed to the protrusion portion when viewed in a direction of a rotational axis, and a second cutaway portion having a shape formed by cutting the flat portion toward a photosensitive drum in the direction of the rotational axis to expose a coupling member when viewed in a direction orthogonal to the rotational axis.

19 Claims, 11 Drawing Sheets

CARTRIDGE AND COVER MEMBER

BACKGROUND

Field

Aspects of the present invention generally relate to a cartridge that includes an electrophotographic photosensitive drum for use in an electrophotographic image forming apparatus.

Description of the Related Art

In an electrophotographic image forming apparatus (hereinafter, also referred to as an "image forming apparatus"), typically, a drum-shaped electrophotographic photosensitive drum serving as an image bearing member is uniformly charged. The charged electrophotographic photosensitive drum is then selectively exposed to form an electrostatic latent image (electrostatic image) on the electrophotographic photosensitive drum. The electrostatic latent image formed on the electrophotographic photosensitive drum is developed as a toner image by using toner serving as a developer. The toner image formed on the electrophotographic photosensitive drum is transferred onto a recording material such as a recording sheet or a plastic sheet. Heat and pressure are applied to the toner image transferred onto the recording material, whereby the toner image is fixed to the recording material for image recording.

Such an image forming apparatus typically needs replenishment of toner and maintenance of various process units. To facilitate the toner replenishment and the maintenance, a process cartridge in which an electrophotographic photosensitive drum, a charging unit, a developing unit, and a cleaning unit are integrated in a frame thereof and which can be detachably mounted on a main body of the image forming apparatus has been used.

Using such a process cartridge system, a user can perform maintenance of the image forming apparatus without any assistance. This can significantly improve operability, and an image forming apparatus having excellent usability can be provided. The process cartridge system is thus widely used in image forming apparatuses.

A main body of the electrophotographic image forming apparatus (hereinafter, also referred to simply as a "main body of the apparatus") conventionally includes a main body-side engagement portion for transmitting rotational power to a rotating member, such as an electrophotographic photosensitive drum. Some apparatus main bodies are known to not include a mechanism for moving the main body-side engagement portion in the direction of a rotational axis of the rotating member according to an opening and closing operation of a main body cover of the main body of the apparatus.

A configuration related to a process cartridge that can be detached from the main body of the apparatus in a predetermined direction substantially orthogonal to the rotational axis of the rotating member has been known.

As for the foregoing configuration, there has also been known a configuration for bringing a coupling member arranged on the process cartridge into engagement with the main body-side engagement portion to transmit the rotational power.

Japanese Patent No. 4498407 discusses a coupling system serving as such a rotational force transmission unit, in which a coupling member arranged on an electrophotographic photosensitive drum unit is configured to be tiltable with respect to the rotational axis of the electrophotographic photosensitive drum unit. Such a configuration enables an engagement operation and a disengagement operation of the coupling unit according to mounting and dismounting operations of the process cartridge on/from the main body of the apparatus.

SUMMARY OF THE INVENTION

Aspects of the present invention are generally directed to an improved cartridge including a photosensitive drum and a coupling member.

According to an aspect of the present invention, a cartridge attachable to a main body of an apparatus includes a photosensitive drum, a support frame configured to rotatably support the photosensitive drum, a coupling member configured to transmit driving force to the photosensitive drum to rotate the photosensitive drum, the coupling member arranged on one end side of the photosensitive drum in a direction of a rotational axis of the photosensitive drum, and a cover member attached to the support frame, wherein the support frame includes an arc portion arranged on one end side, which corresponds to the one end side of the photosensitive drum, of the support frame in the direction of the rotational axis, with a center of axis of the arc portion being the rotational axis, and a protrusion portion configured to make contact with a guide portion of the main body and be regulated in position in the direction of the rotational axis, the protrusion portion protruding radially outward from an outer peripheral surface of the arc portion, and wherein the cover member includes a flat portion, a substantially circular hole portion formed in the flat portion, the arc portion being inserted through the hole portion, a first cutaway portion having a shape formed by cutting in the hole portion radially outward, the first cutaway portion arranged in a position opposed to the protrusion portion when viewed in the direction of the rotational axis, and a second cutaway portion having a shape formed by cutting the flat portion toward the photosensitive drum in the direction of the rotational axis to expose the coupling member when viewed in a direction orthogonal to the rotational axis.

Further features of the aspects of the present invention will become apparent from the following description of exemplary embodiments with reference to the attached drawings.

DESCRIPTION OF THE EMBODIMENTS

Figure 1:
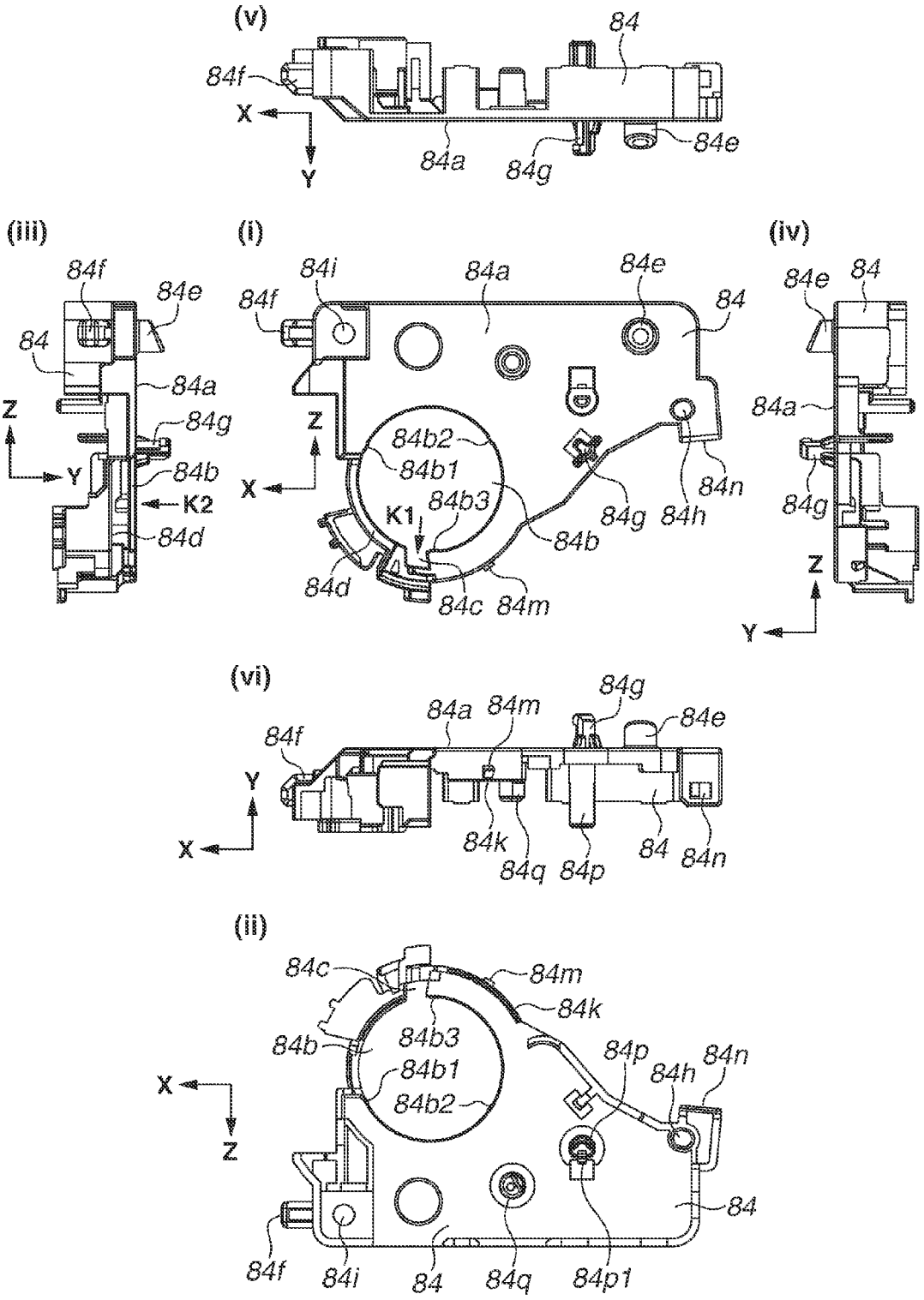
FIG. 1 is a six-sided view of a cover member.

An exemplary embodiment of the present invention is described in detail below with reference to the drawings. A direction parallel to the rotational axis of an electrophotographic photosensitive drum is referred to as a longitudinal direction. The longitudinal direction is the same as a Y direction in the drawings. Directions orthogonal to the Y direction are referred to as an X direction and a Z direction. The X direction and the Z direction are orthogonal to each other. The X, Y, and Z directions are common in all the drawings. A side on which the electrophotographic photosensitive drum receives driving force from a main body an electrophotographic image forming apparatus in the longitudinal direction is referred to as a drive side (one end side). The opposite side is referred to as a non-drive side (the other end side).

Figure 2:
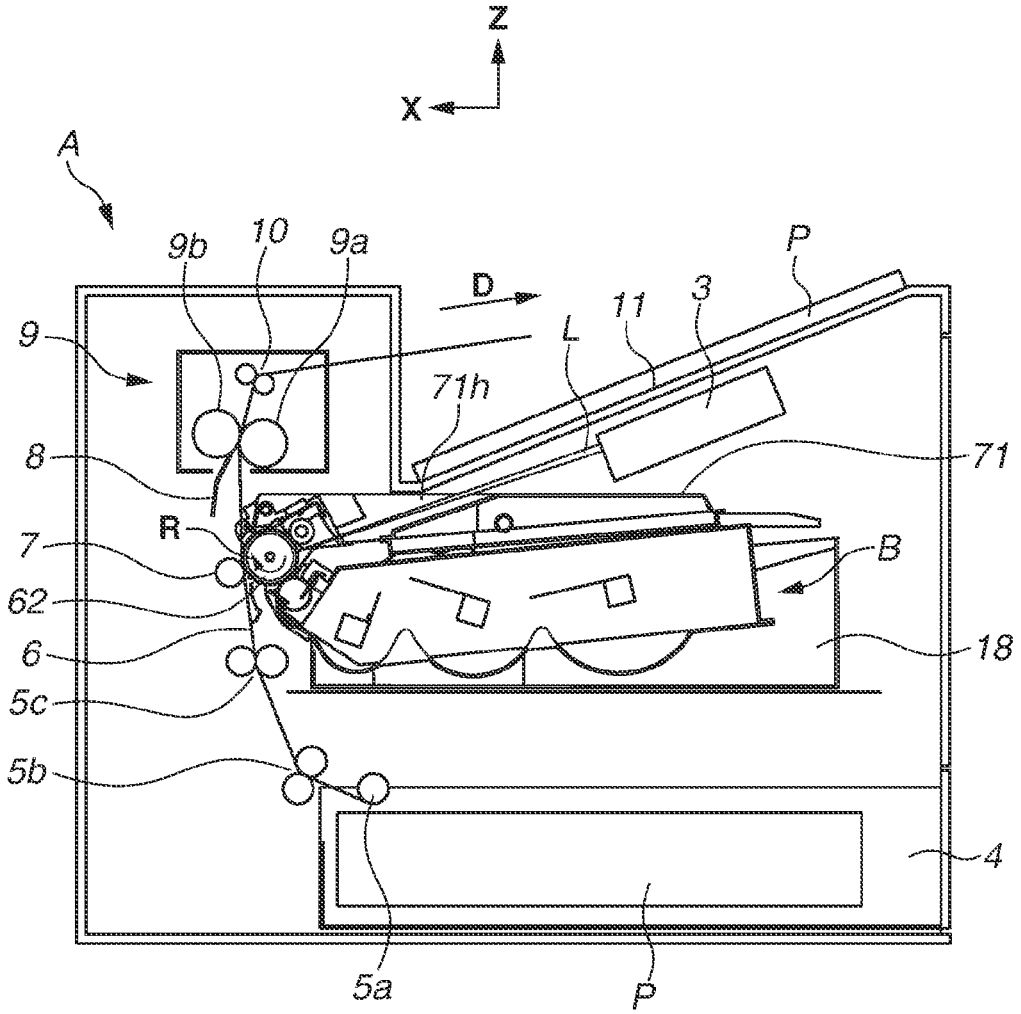
FIG. 2 is a sectional view illustrating a main body of an electrophotographic image forming apparatus and a process cartridge of the electrophotographic image forming apparatus.
Figure 3:
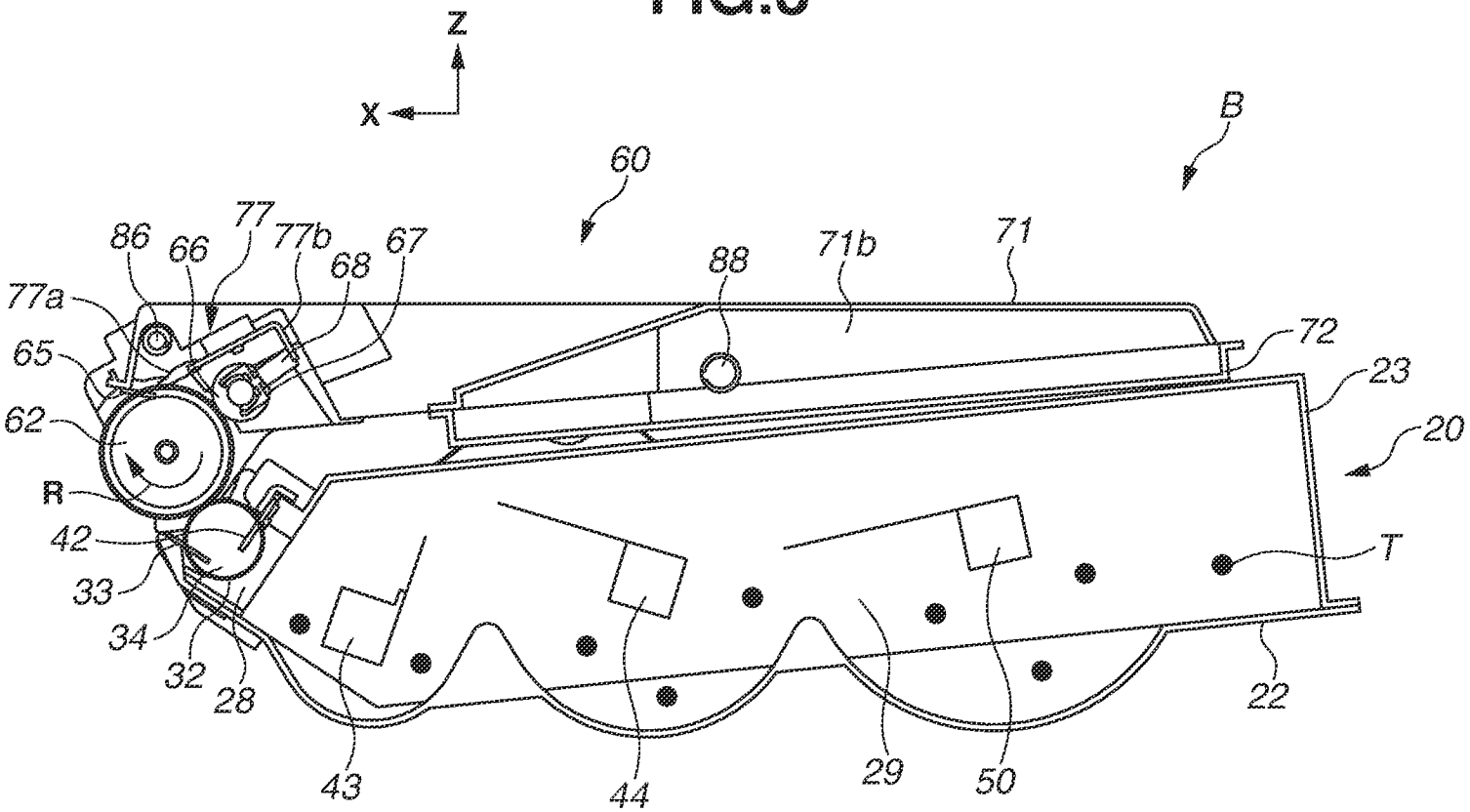
FIG. 3 is a sectional view illustrating the process cartridge.

An overall configuration and an image forming process is described with reference to FIGS. 2 and 3. FIG. 2 is a sectional view of a main body of an electrophotographic image forming apparatus A and a process cartridge B of the electrophotographic image forming apparatus according to an exemplary embodiment of the present invention. FIG. 3 is a sectional view of the process cartridge B. As employed herein, the main body of the electrophotographic image forming apparatus A refers to the electrophotographic image forming apparatus with the process cartridge B removed.

<Overall Configuration of Electrophotographic Image Forming Apparatus>

The electrophotographic image forming apparatus illustrated in FIG. 2 is a laser beam printer using an electrophotographic technique, in which the process cartridge B (hereinafter, referred to as a cartridge B) is configured to be detachably mountable on the main body of the electrophotographic image forming apparatus (hereinafter, referred to as a main body of the apparatus A). An exposure device 3 (laser scanner unit) forms a latent image on an electrophotographic photosensitive drum (hereinafter, referred to as a drum 62) when the cartridge B is mounted on the main body of the apparatus A. The drum 62 is a rotating member arranged in the cartridge B. A sheet tray 4 that contains a recording medium (hereinafter, referred to as a sheet material P) intended for image formation is arranged under the cartridge B.

The main body of the apparatus A also includes a pickup roller 5*a*, a feed roller pair 5*b*, a conveyance roller pair 5*c*, a transfer guide 6, a transfer roller 7, a conveyance guide 8, a fixing device 9, a discharger roller pair 10, and a discharge tray 11 that are arranged in such order along a conveyance direction D of a sheet material P. The fixing device 9 includes a heating roller 9*a* and a pressure roller 9*b*.

<Image Forming Process>

Next, an outline of the image forming process is described with reference to FIGS. 2 and 3. The drum 62 is driven to rotate in the direction of the arrow R at a predetermined circumferential speed (process speed) based on a print start signal.

A charging roller 66, to which a bias voltage is applied, makes contact with an outer peripheral surface of the drum 62 to uniformly charge the outer peripheral surface of the drum 62.

The exposure apparatus 3 outputs laser light L according to image information. The laser light L passes through a laser opening 71*h* formed in a cleaning frame 71 of the cartridge B, and scans and exposes the outer peripheral surface of the drum 62. An electrostatic latent image corresponding to the image information is thereby formed on the outer peripheral surface of the drum 62.

As illustrated in FIG. 3, in a developing unit 20 serving as a developing device, toner T in a toner chamber is agitated and conveyed by rotation of a first conveyance member 43, a second conveyance member 44, and a third conveyance member 50, and fed to a toner supply chamber 28

The toner T is borne on the surface of a developing roller 32 by magnetism of a magnet roller 34 (stationary magnet). A developing blade 42 frictionally charges the toner T and regulates the thickness of the toner T on the peripheral surface of the developing roller 32. The toner T is developed on the drum 62 according to the electrostatic latent image and visualized as a toner image.

As illustrated in FIG. 2, a sheet material P contained in the lower part of the main body of the apparatus A is fed from the sheet tray 4 by the pickup roller 5*a*, the feed roller pair 5*b*, and the conveyance roller pair 5*c* according to output timing of the laser light L. The sheet material P is then conveyed to a transfer position between the drum 62 and the transfer roller 7 after passing through the transfer guide 6. At this transfer position, the toner image is sequentially transferred from the drum 62 to the sheet material P.

The sheet material P to which the toner image has been transferred is separated from the drum 62 and conveyed to the fixing device 9 along the conveyance guide 8. The sheet material P then passes a nip portion between the heating roller 9*a* and the pressure roller 9*b* that constitute the fixing device 9. Pressure and heat fixing processing is performed in the nip portion, whereby the toner image is fixed to the sheet material P. The sheet material P to which the toner image has been fixed is conveyed to the discharge roller pair 10 and discharged to the discharge tray 11.

Meanwhile, as illustrated in FIG. 3, a cleaning member 77 removes residual toner from the outer peripheral surface of the drum 62 after the transfer. The drum 62 is then used again for the image forming process. The toner removed from the drum 62 is reserved in a waste toner chamber 71*b*.

The charging roller 66, the developing roller 32, the transfer roller 7, and the cleaning member 77 described above are process units acting on the drum 62.

<Mounting and Dismounting of Cartridge on/from Tray>

Figure 4A:
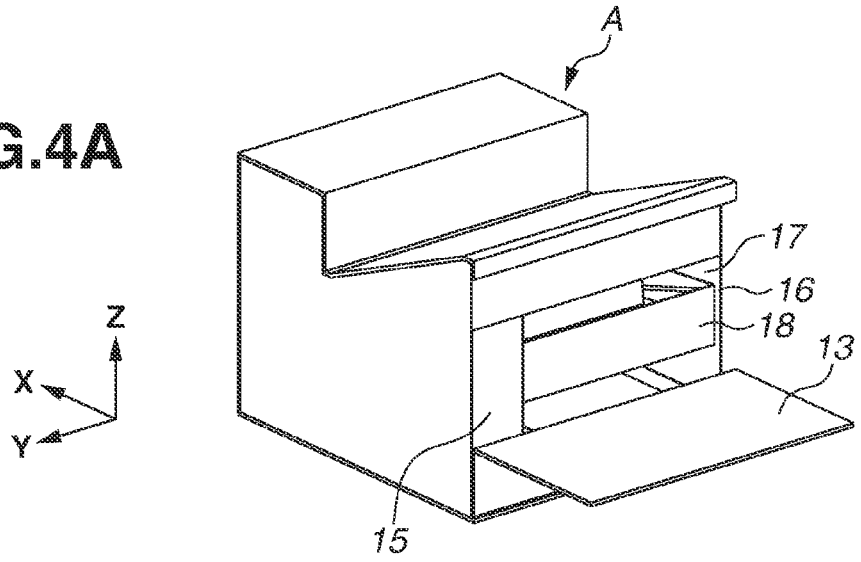
FIGS. 4A, 4B and 4C are perspective views each illustrating how the process cartridge is mounted and dismounted on/from a tray provided on the main body of the electrophotographic image forming apparatus.
Figure 4B:
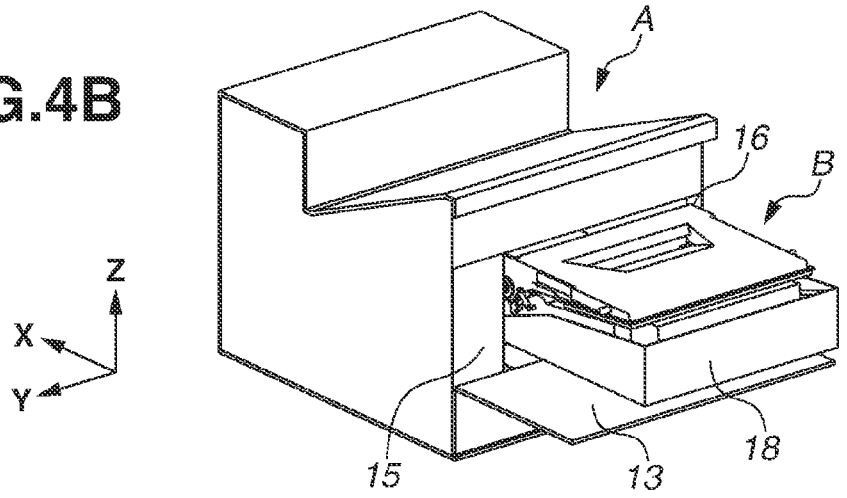
Figure 4C:
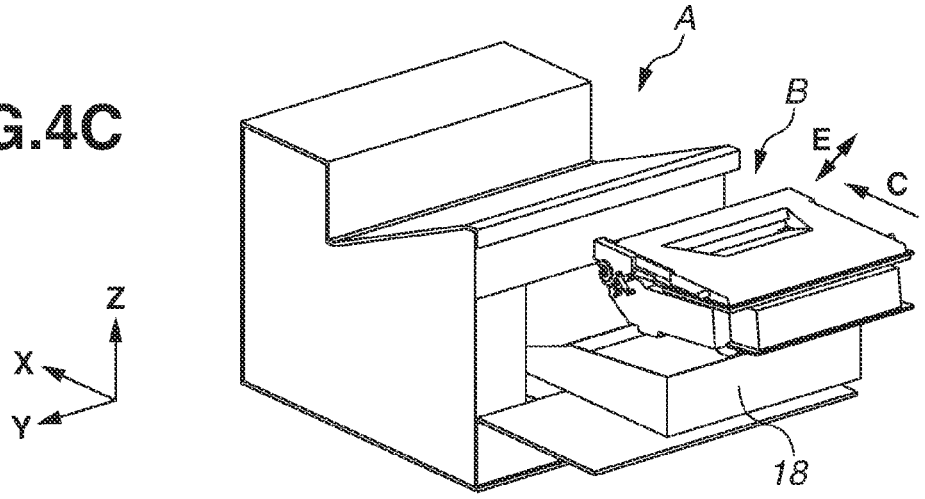

Mounting and dismounting of the cartridge B on/from a tray 18 provided in the main body of the apparatus A is described with reference to FIGS. 4A to 4C. FIGS. 4A to 4C are explanatory diagrams illustrating how the cartridge B is mounted or dismounted on/from the tray 18 provided in the main body of the apparatus A. FIG. 4A is a perspective view illustrating a state in which an opening/closing door 13 of the main body of the apparatus A is opened. FIG. 4B is a perspective view illustrating a state in which the tray 18 on which the cartridge B is mounted is drawn out of the main body of the apparatus A to a predetermined position. FIG. 4C is a perspective view illustrating a state in which the tray 18 is drawn out of the main body of the apparatus A to the predetermined position and the cartridge B is mounted or dismounted.

As illustrated in FIG. 4A, the opening/closing door 13 is rotatably attached to the main body of the apparatus A. If the opening/closing door 13 is opened, a cartridge insertion opening 17 appears. The tray 18 for mounting the cartridge B on the main body of the apparatus A is arranged in the cartridge insertion opening 17. The tray 18 can be drawn out to the predetermined position illustrated in FIG. 4B.

As illustrated in FIG. 4C, when the tray 18 is drawn out to the predetermined position, the cartridge B can be mounted or dismounted on/from the tray 18 in a mounting/dismounting direction E. The tray 18 can be moved and accommodated into the main body of the apparatus A in an insertion direction C.

<Cartridge Support>

Figure 5A:
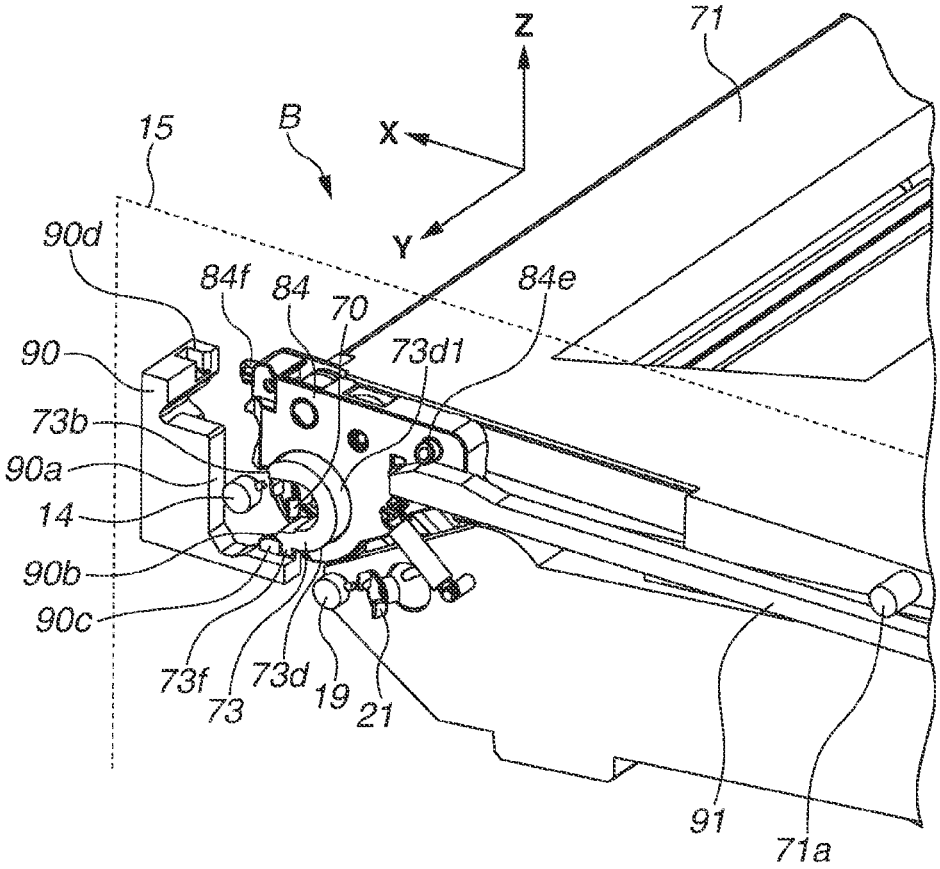
FIGS. 5A and 5B are perspective views each illustrating a state in which mounting of the process cartridge in the main body of the electrophotographic image forming apparatus is yet to be completed.
Figure 5B:
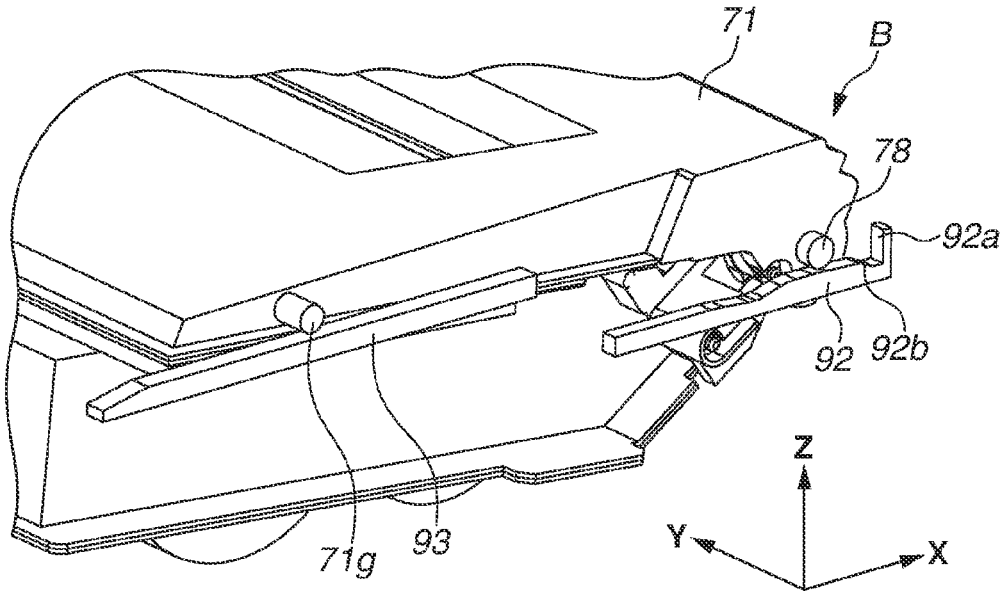
Figure 6A:
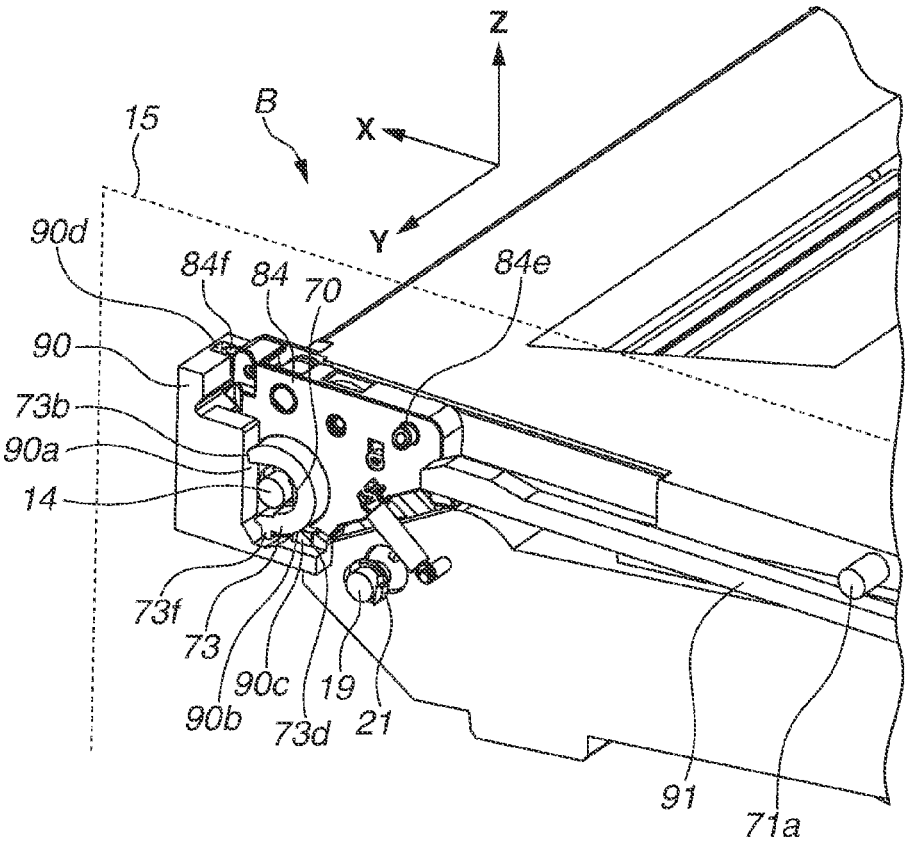
FIGS. 6A and 6B are perspective views each illustrating a state in which the process cartridge is in a mounting completion position in the main body of the electrophotographic image forming apparatus.
Figure 6B:
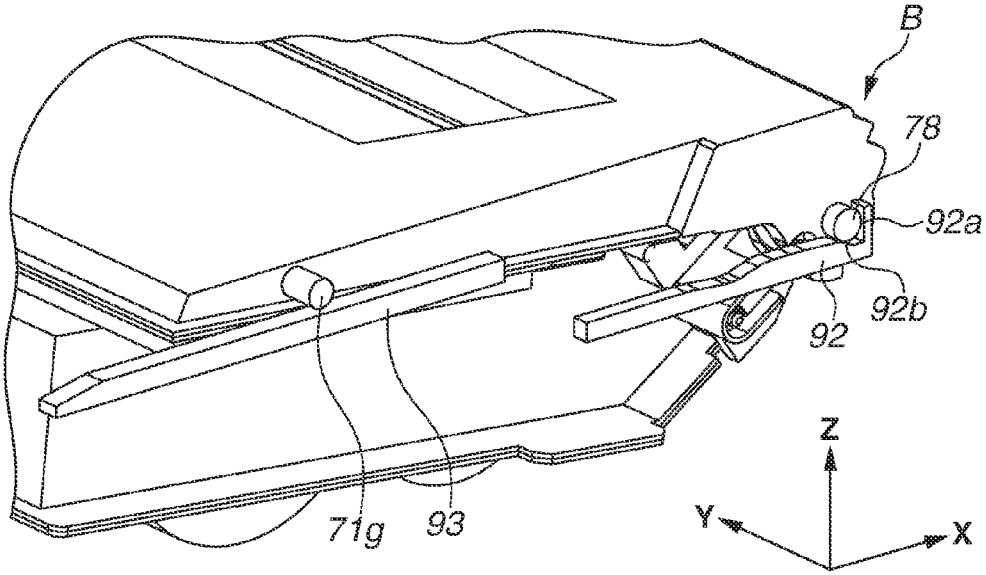

A configuration of the main body of the apparatus A for supporting the cartridge B is described with reference to FIGS. 5A to 6B. FIGS. 5A and 5B are perspective views illustrating a state in which the mounting of the cartridge B in the main body of the apparatus A is yet to be completed. FIG. 5A is a perspective view from the drive side. FIG. 5B is a perspective view from the non-drive side. FIGS. 6A and 6B are perspective views each illustrating a state in which the cartridge B is in a mounting completion position. FIG. 6A is a perspective view from the drive side. FIG. 6B is a perspective view from the non-drive side.

The main body of the apparatus A includes a drive-side plate 15 and a non-drive-side plate 16 for supporting the cartridge B (FIG. 4A).

As illustrated in FIG. 5A, a drive-side support member 90 and a drive-side rotation support member 91 are attached to the drive-side plate 15 of the main body of the apparatus A. The drive-side support member 90 includes a drive-side first support portion 90*a*, a drive-side second support portion 90*b*, a first longitudinal regulation portion 90*c*, and a second longitudinal regulation portion 90*d*. The first and second longitudinal regulation portions 90*c* and 90*d* are guide portions. A first main body-side engagement portion 14 and a second main body-side engagement portion 19 are provided on the drive side of the main body of the apparatus A. The first and second main body-side engagement portions 14 and 19 transmit driving force to, respectively, a first coupling member 70 and a second coupling member 21 provided on the cartridge B.

A drum bearing member 73 is attached on the drive side of the cleaning frame 71 of the cartridge B. The drum bearing member 73 rotatably supports the drum 62. The first coupling member 70 for transmitting a drive to the drum 62 is arranged on the drive side of the drum 62. In the following description, an integrated frame member that rotatably supports the drum 62, including the drum bearing member 73 and the cleaning frame 71 of the cartridge B, is referred to as a support frame.

The drum bearing member 73 includes a drive-side first supported portion 73*b*, a drive-side second supported portion 73*d*, and a first longitudinal regulated portion 73*f*. The first longitudinal regulated portion 73*f* is a protrusion portion protruding radially outward about the rotational axis of the drum 62. The drive-side second supported portion 73*d* is an arc portion protruding longitudinally to the drive side. An outer peripheral surface 73*d*1 of the drive-side second supported portion 73*d* is an arc surface with the rotational axis of the drum 62 as a center axis. The drive-side second supported portion 73*d* is arranged in a manner to accommodate at least part of the first coupling member 70. In other words, the first coupling member 70 is inserted into a hole formed in the center of the arc portion. A drive-side third supported portion 84*e* and a second longitudinal regulated portion 84*f* are provided on a cover member 84. A drive-side rotation supported boss 71*a* is arranged on the cleaning frame 71.

As illustrated in FIG. 5B, a non-drive-side support member 92 and a non-drive-side rotation support member 93 are attached to the non-drive-side plate 16 of the main body of the apparatus A. The non-drive-side support member 92 includes a non-drive-side first support portion 92*a* and a non-drive-side second support portion 92*b*. A drum shaft 78 and a non-drive-side rotation supported boss 71*g* are arranged on the non-drive side of the cartridge B.

As illustrated in FIGS. 5A and 5B, in a state where the mounting of the cartridge B in the main body of the apparatus A is yet to be completed, the drive-side third supported portion 84*e* and the drive-side rotation supported boss 71*a* are supported by the drive-side rotation support member 91 on the drive side. On the non-drive side, the drum shaft 78 is supported by the non-drive side support member 92, and the non-drive-side rotation supported boss 71*g* is supported by the non-drive-side rotation support member 93. This can restrain the cartridge B from descending, and the second main body-side engagement portion 19 and the drum bearing member 73 can be prevented from interfering with each other in the process of insertion.

The first longitudinal regulation portion 90*c* engages with the first longitudinal regulated portion 73*f*. This can restrain the support frame of the cartridge B from moving to the non-drive side. The first coupling member 70 and the second coupling member 21 can thus start to engage with the first main body-side engagement portion 14 and the second main body-side engagement portion 19, respectively, according to a mounting operation of the cartridge B.

FIGS. 6A and 6B illustrate the state where the cartridge B placed on the tray 18 is moved to the mounting completion position of the main body of the apparatus A. On the drive side, the drive-side first supported portion 73*b* comes into contact with the drive-side first support portion 90*b*, whereby the position of the support frame of the cartridge B in the X direction is determined. The outer peripheral surface 73*d*1 of the drive-side second supported portion 73*d* makes contact with and is supported by the drive-side second support portion 90*d*, and the drive-side rotation supported boss 71*a* is supported by the drive-side rotation support portion 91, whereby the position of the support frame of the cartridge B in the Z direction is determined.

The drum shaft 78 is supported by the non-drive-side first support portion 92*a* and the non-drive-side second support portion 92*b*. The non-drive-side rotation supported boss 71*g* is supported by the non-drive-side rotation support member 93.

As illustrated in FIG. 6A, the first longitudinal regulation portion 90*c* and the first longitudinal regulated portion 73*f* that have been engaged with each other are disengaged. Instead, the second longitudinal regulated portion 84*f* is engaged with the second longitudinal regulation portion 90*d*. This regulates the longitudinal movement of the support frame of the cartridge B, whereby the longitudinal position thereof is determined. In terms of the positioning of the support frame in the longitudinal direction, the second longitudinal regulation portion 90*d* serves as a first positioning portion. The second longitudinal regulated portion 84*f* serves as a first positioned portion that fits to and makes contact with the first positioning portion. The drive-side second support portion 90*a* and the first longitudinal regulation portion 90*c* each serve as a second positioning portion that determines the position of the support frame in a direction orthogonal to the longitudinal direction. The drive-side first supported portion 73*b* and a portion of the outer peripheral surface 73*d*1 of the drive-side second supported portion 73*d* in contact with the drive-side second support portion 90*b* serve as a second positioned portion.

In such a state, the cartridge B is positioned inside the main body of the apparatus A.

The first coupling member 70 and the second coupling member 21 are restored from a tilted movement (inclined and rotated) and complete engaging with the first main body-side engagement portion 14 and the second main body-side engagement portion 19, respectively.

The first main body-side engagement portion 14 and the second main body-side engagement portion 19 are then driven by a motor (not illustrated) of the main body of the apparatus A. The drum 62 connected with the first coupling member 70 thereby receives driving force from the main body of the apparatus A to rotate. The second coupling member 21 transmits driving force to rotate the developing roller 32. The charging roller 66 and the developing roller 32 are also supplied with power from a power feeding unit (not illustrated) of the main body of the apparatus A.

<Configuration of Entire Cartridge>

Figure 7A:
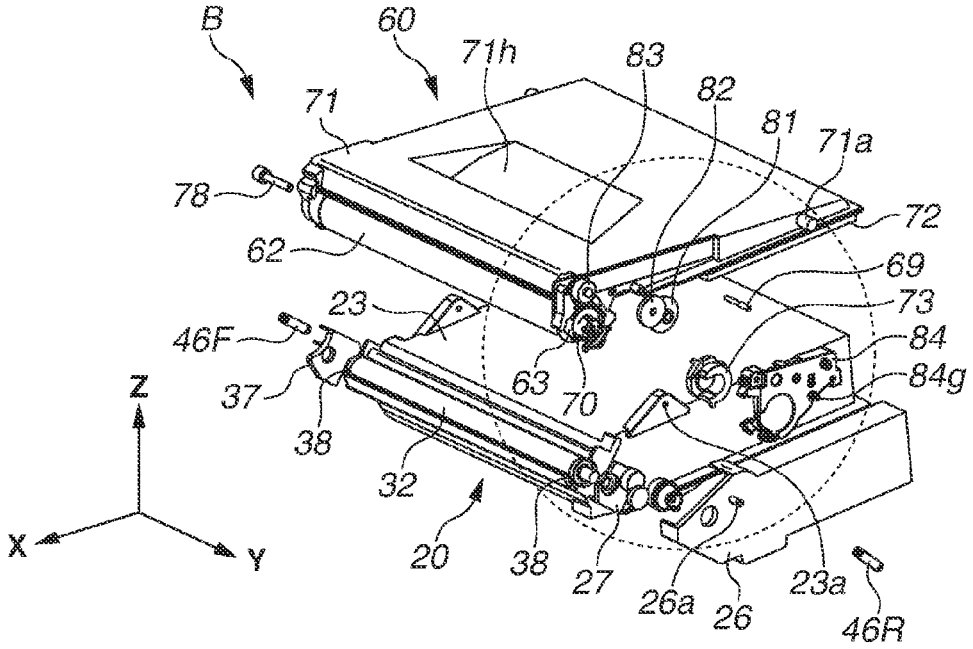
FIGS. 7A and 7B are exploded perspective views each illustrating the process cartridge from a drive side.
Figure 7B:
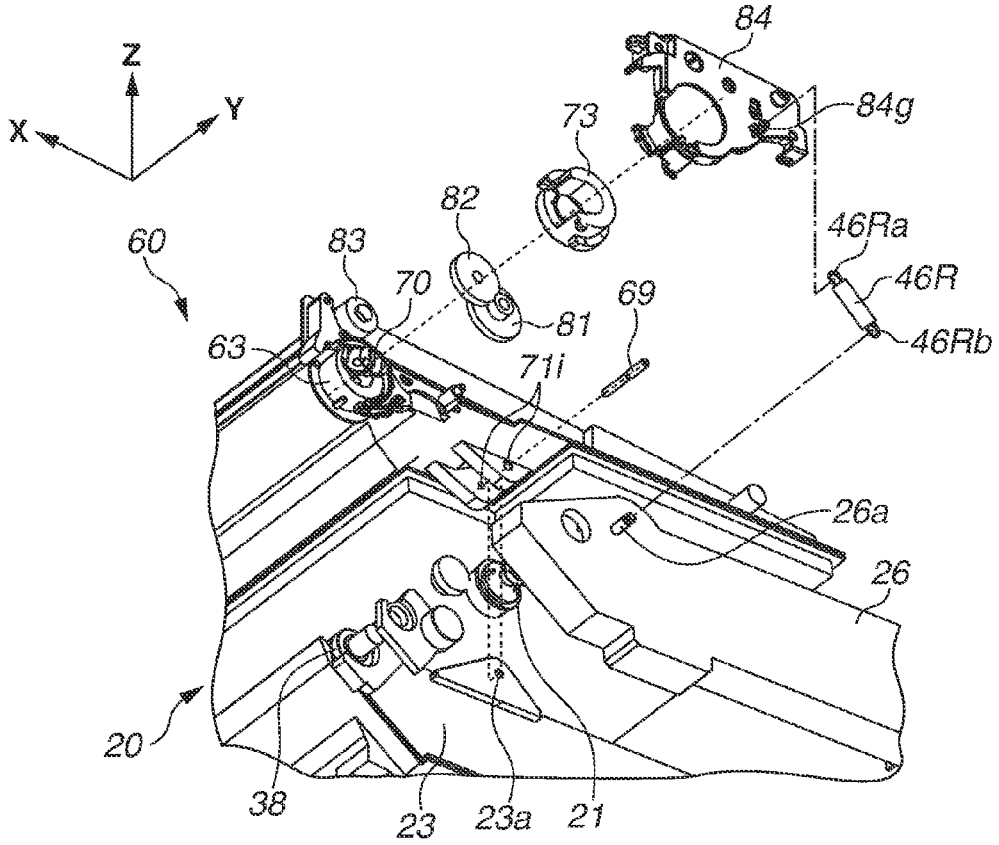
Figure 8A:
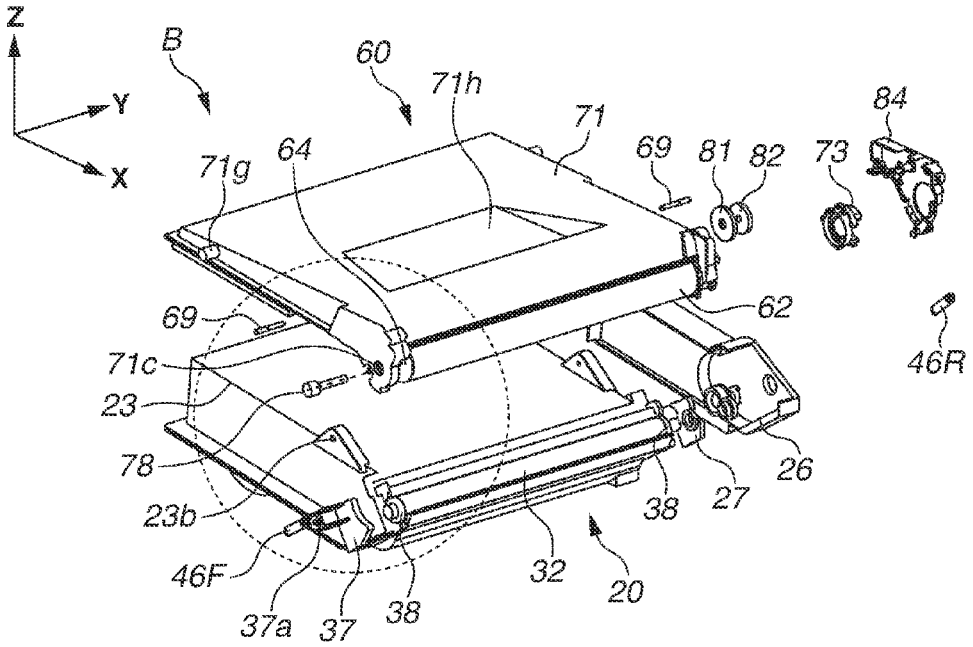
FIG. 8A is an exploded perspective view illustrating the process cartridge from a non-drive side.
Figure 8B:
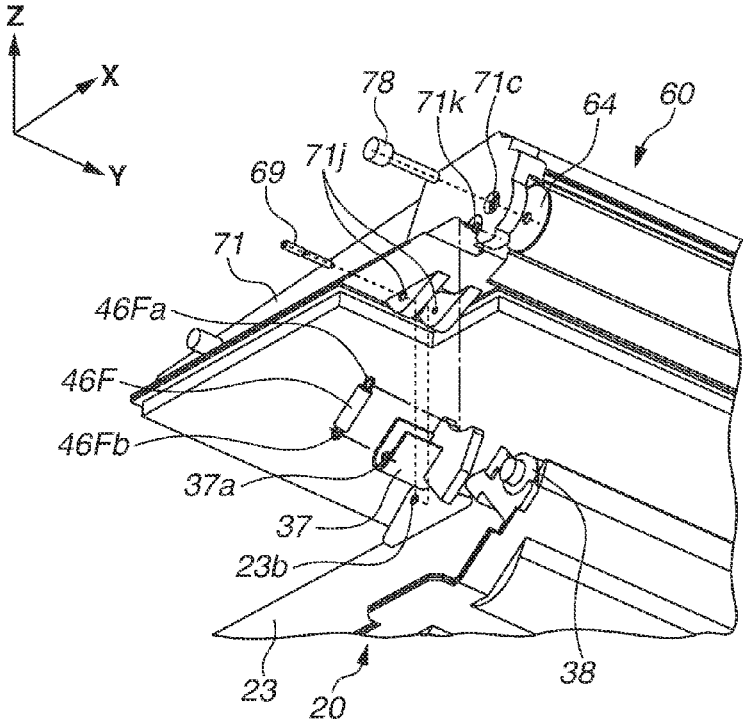
FIG. 8B is a partially enlarged view illustrating the exploded perspective view of the process cartridge from the non-drive side.

Next, an overall configuration of the cartridge B is described with reference to FIGS. 3 and 7A to 8B. FIGS. 7A and 7B are exploded perspective views each illustrating the cartridge B viewed from the drive side. FIG. 7A is a view illustrating the entire cartridge B. FIG. 7B is an enlarged view illustrating an area inside the dotted line of FIG. 7A from a different angle. FIGS. 8A and 8B are exploded perspective views each illustrating the cartridge B viewed from the non-drive side. FIG. 8A is a view illustrating the entire cartridge B. FIG. 8B is an enlarged view illustrating an area inside the dotted line of FIG. 8A from a different angle. In FIGS. 7A to 8B, screws for connecting the components are omitted.

The cartridge B includes a cleaning unit 60 and the developing unit 20. In an exemplary embodiment of the present invention, a process cartridge includes at least the cleaning unit 60.

As illustrated in FIG. 3, the cleaning unit 60 includes the drum 62, the charging roller 66, the cleaning member 77, the cleaning frame 71 supporting such components, and a lid member 72 fixed to the cleaning frame 71 by welding or other fixing methods. In the cleaning unit 60, the charging roller 66 and the cleaning member 77 are both arranged in contact with the outer peripheral surface of the drum 62.

The cleaning member 77 includes a rubber blade 77*a* that is a blade-shaped elastic member made of rubber serving as an elastic material, and a support member 77*b* that supports the rubber blade 77*a*. The rubber blade 77*a* is in contact with the drum 62 in a counter direction with respect to the rotation direction of the drum 62. In other words, the rubber blade 77*a* is in contact with the drum 62 so that its end is directed upstream in the rotation direction of the drum 62.

As illustrated in FIG. 3, waste toner removed from the surface of the drum 62 by the cleaning member 77 is conveyed by a first screw 86, a second screw (not illustrated), and a third screw 88 in order. The first to third screws each serve as a waste toner conveyance member. The conveyed waste toner is stored in the waste toner chamber 71*b* that is formed by the cleaning frame 71 and the lid member 72.

As illustrated in FIG. 7B, the driving force input from the second coupling member 21 is transmitted to a second coupling gear 79, a first idler gear 81, a second idler gear 82, a screw gear 83, and the first screw 86 (FIG. 3) in order, whereby the first screw 86 is rotated.

As illustrated in FIG. 3, a sheet 65 for preventing leakage of the waste toner from the cleaning frame 71 is arranged on a rim portion of the cleaning frame 71 to make contact with the drum 62.

The first coupling member 70 (FIGS. 7A and 7B) connected with the drum 62 receives driving force transmitted from a main body driving motor (not illustrated) serving as a driving source. The drum 62 is thereby driven to rotate integrally with the first coupling member 70 in the direction of the arrow R in FIG. 3, and performs an image forming operation.

The charging roller 66 is rotatably attached to the cleaning unit 60 via charging roller bearings 67 at both longitudinal ends of the cleaning frame 71. Urging members 68 press the charging roller bearings 67 toward the drum 62, whereby the charging roller 66 is pressed against the drum 62. The charging roller 66 is driven to rotate by the rotation of the drum 62.

As illustrated in FIG. 3, the developing unit 20 includes the developing roller 32, a developing container 23 supporting the developing roller 32, and the developing blade 42. The magnet roller 34 is arranged in the developing roller 32. The developing blade 42 for regulating a toner layer on the developing roller 32 is arranged in the developing unit 20. As illustrated in FIGS. 7A to 8B, spacer members 38 are attached to both ends of the developing roller 32. The spacer members 38 make contact with the drum 62, whereby the developing roller 32 and the drum 62 are held with a small gap therebetween.

As illustrated in FIG. 3, a blowout prevention sheet 33 for preventing leakage of the toner T from the developing unit 20 is arranged on a rim portion of a bottom member 22 to make contact with the developing roller 32. The developing container 23 and the bottom member 22 form the toner chamber 29, in which the first conveyance member 43, the second conveyance member 44, and the third conveyance member 50 are arranged. The first, second, and conveyance members 43, 44, and 50 agitate the toner T accommodated in the toner chamber 29 and convey the toner T to the toner supply chamber 28.

The cartridge B is constituted by combining the cleaning unit 60 and the developing unit 20.

As illustrated in FIGS. 7A and 7B, the cleaning unit 60 includes the cleaning frame 71, the lid member 72, the drum 62, and the drum bearing members 73 and the drum shaft 78 intended to rotatably support the drum 62. The cleaning frame 71 to which the lid member 72, the drum bearing members 73, and the drum shaft 78 are attached is used as the support frame for rotatably supporting the drum 62.

On the drive side, as illustrated in FIG. 7B, a drive-side drum flange 63 arranged on the drive side of the drum 62 is rotatably supported by the drum bearing member 73.

On the non-drive side, as illustrated in FIG. 8B, the drum shaft 78 is fixed to a hole portion 71*c* formed in the cleaning frame 71. The drum shaft 78 is configured to rotatably support a hole portion (not illustrated) of a non-drive-side drum flange 64.

As illustrated in FIGS. 3, 7A, and 7B, the developing unit 20 includes the bottom member 22, the developing container 23, a drive-side developing side member 26, the developing blade 42, and the developing roller 32. The developing roller 32 is rotatably attached to the developing container 23 by bearing members 27 and 37 arranged on both ends.

As illustrated in FIGS. 7A to 8B, the cleaning unit 60 and the developing unit 20 are rotatably connected to each other using connection pins 69, whereby the cartridge B is constituted. Specifically, a developing first support hole 23*a* and a developing second support hole 23*b* are formed in the developing container 23 at both longitudinal ends of the developing unit 20. First suspension holes 71*i* and second suspension holes 71*j* are formed in the cleaning frame 71 at both longitudinal ends of the cleaning unit 60. The connection pins 69 respectively pressed and fixed into the first and second suspension holes 71*i* and 71*j* are respectively engaged with the developing first and second support holes 23*a* and 23*b*, whereby the cleaning unit 60 and the developing unit 20 are rotatably connected to each other.

A drive-side biasing member 46R includes a first hole portion 46Ra and a second hole portion 46Rb. The first hole portion 46Ra is put on a spring boss 84*g*. The second hole portion 46Rb is put on a boss 26*a* of the driving-side developing side member 26.

A non-drive-side biasing member 46F includes a first hole portion 46Fa and a second hole portion 46Fb. The first hole portion 46Fa is put on a boss 71*k* of the cleaning frame 71. The second hole portion 46Fb is put on a boss 37*a* of the bearing member 37.

In the present exemplary embodiment, the drive-side biasing member 46R and non-drive-side biasing member 46F are tension springs. The biasing force of the tension springs biases the developing unit 20 toward the cleaning unit 60 so that the developing roller 32 is reliably pressed toward the drum 62. The spacer members 38 attached to both ends of the developing roller 32 maintain the developing roller 32 at a predetermined distance from the drum 62.

<Description of Cover Member>

Figure 9A:
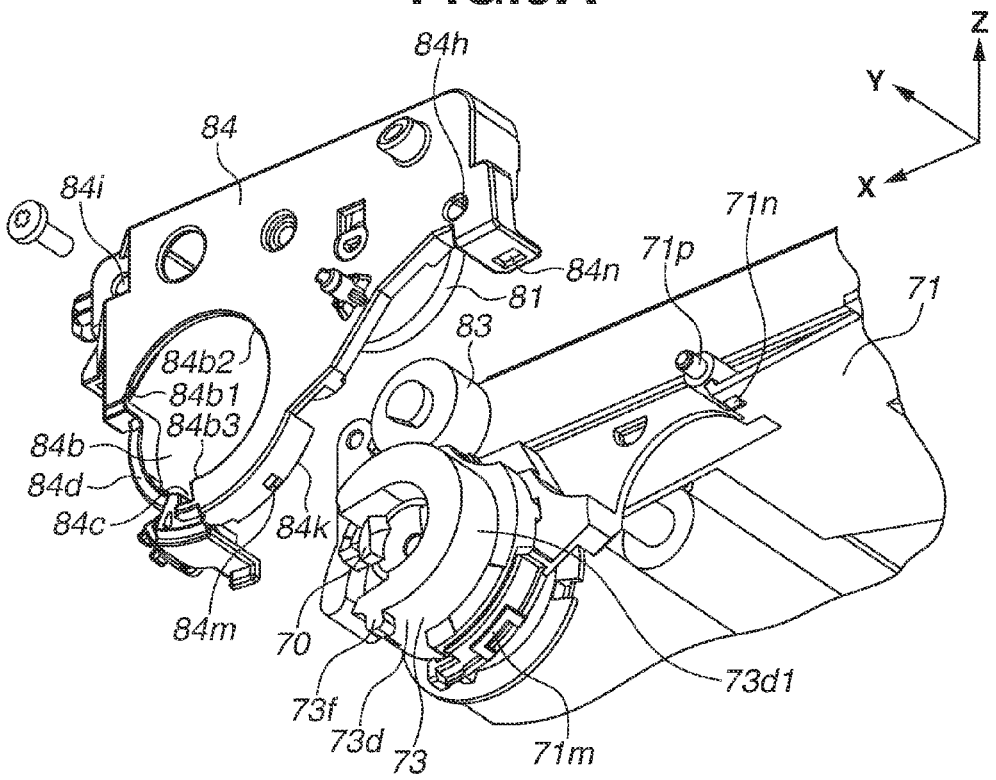
FIGS. 9A and 9B are exploded perspective views each illustrating how the cover member is attached.
Figure 9B:
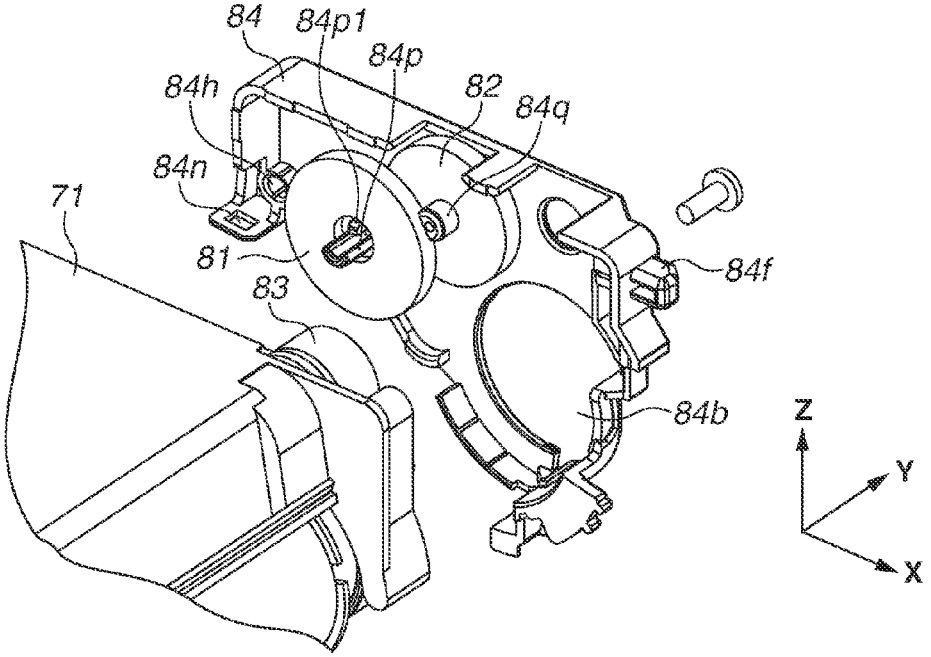
Figure 10:
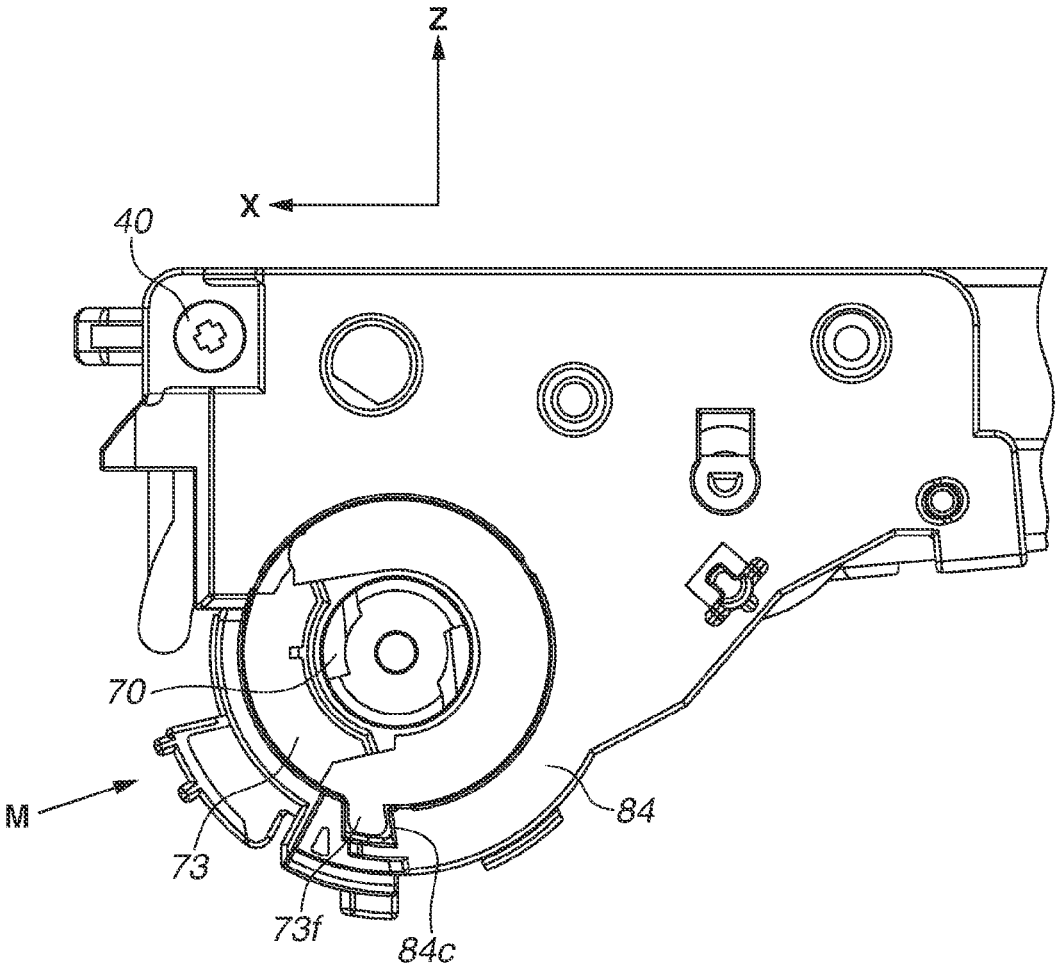
FIG. 10 is a view illustrating the cover member attached to a cleaning frame from the direction of the rotational axis of an electrophotographic photosensitive drum.
Figure 11:
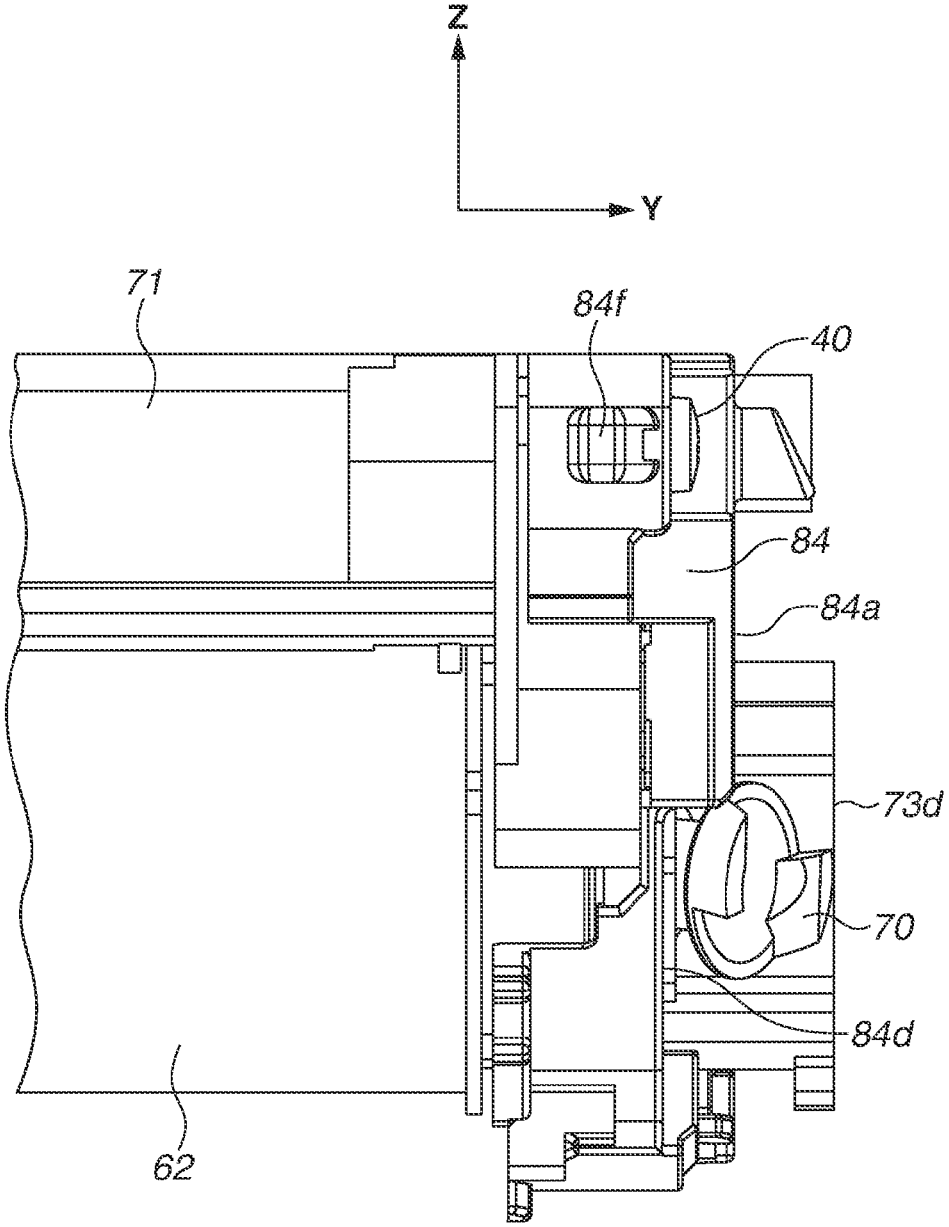
FIG. 11 is a view illustrating the cover member attached to the cleaning frame from a direction orthogonal to the rotational axis of the electrophotographic photosensitive drum.

The cover member 84 is described with reference to FIGS. 1, 9A, 9B, 10, and 11. FIG. 1 is a six-sided view of the cover member 84. FIG. 1(*i*) is a front view, FIG. 1(*ii*) a rear view, FIG. 1(*iii*) a left side view, FIG. 1(*iv*) a right side view, FIG. 1(*v*) a top view, and FIG. 1(*vi*) a bottom view. FIGS. 9A and 9B are exploded perspective views illustrating how the cover member 84 is attached. FIG. 9A is a view from the drive side. FIG. 9B is a view from the non-drive side. FIG. 10 is a view of the cover member 84 attached to the cleaning frame 71 from the drive side in the Y direction. FIG. 11 is a view of the cover member 84 attached to the cleaning frame 71 from downstream to upstream in the X direction.

A shape of the cover member 84 is described with reference to FIG. 1. The cover member 84 is a member molded of a resin material. The cover member 84 includes a flat portion 84*a* and a substantially circular hole portion 84*b* formed in the flat portion 84*a*. The center position of the arcuate rim of the hole portion 84*b* falls on the rotational axis of the drum 62. A normal direction of the flat portion 84*a* is parallel to the rotational axis of the drum 62 and the Y direction (see FIG. 1(*iii*)). As viewed in the longitudinal direction, the cover member 84 includes a first cutaway portion 84*c* in a position facing to the first longitudinal regulated portion 73*f* of the drum bearing member 73. The first cutaway portion 84*c* has a shape formed by cutting the peripheral edge portion of the hole portion 84*b* outward in a radial direction thereof. The radial direction refers to one about the rotational axis of the drum 62 that is the center of the hole portion 84*b*. As is evident from FIG. 1(*i*), the first cutaway portion 84*c* is formed toward a K1 direction from the center of the hole portion 84*a*. The K1 direction is the cut direction of the first cutaway portion 84*c*. The K1 direction intersects with the X direction. Contact portions 84*b*1, 84*b*2, and 84*b*3 protruding radially inward by a small amount are formed on the rim of the hole portion 84*b*.

The cover member 84 also includes a second cutaway portion 84*d*. As illustrated in FIG. 11, the second cutaway portion 84*d* has a shape formed by cutting the flat portion 84*a* toward the drum 62 (photosensitive drum) side in the direction of the rotational axis of the drum 62 (normal direction of the flat portion 84*a*) so that the first coupling member 70 is exposed when viewed from downstream to upstream in the X direction. As illustrated in FIG. 1(*iii*), the second cutaway portion 84*d* is formed by cutting the flat portion 84*a* in a K2 direction. The K2 direction is parallel to the direction of the rotational axis of the drum 62 (normal direction of the flat portion 84*a*) and the Y direction. The second cutaway portion 84*d* is intended to prevent the first main body-side engagement portion 14 from making contact with the cover member 84 when the cartridge B is mounted, so that the first main body-side engagement portion 14 can be engaged with the first coupling member 70. In the present exemplary embodiment, the direction in which the first main body-side engagement portion 14 moves with respect to the first coupling member 70 immediately before the first main body-side engagement unit 14 and the first coupling member 70 are engaged with each other is an M direction in FIG. 10. The M direction is a direction orthogonal to the direction of the rotational axis of the drum 62 (Y direction). The second cutaway portion 84*d* is formed to expose the first coupling member 70 when viewed in the M direction. The first and second cutaway portions 84*c* and 84*d* are located in positions not overlapping circumferentially with respect to the center of the hole portion 84*b*.

The cover member 84 includes a rotation regulated hole 84*h* that is a portion to be engaged with the cleaning frame 71, and a screw fixing hole 84*i* that is intended for fixing the cover member 84 to the cleaning frame 71 by a screw 40. The cover member 84 also includes a fixing portion 84*k* that is a portion to be bonded to the cleaning frame 71, and a first locking portion 84*m* and a second locking portion 84*n* to be fitted to the cleaning frame 71.

The flat portion 84*a* of the cover member 84 includes a first boss 84*p* and a second boss 84*q*. The first boss 84*p* serves as a first gear support shaft that rotatably supports the first idler gear 81. The second boss 84*q* serves as a second gear support shaft that rotatably supports the second idler gear 82. The first boss 84*p* includes a third locking portion 84*p*1 on the end thereof. As illustrated in FIG. 1(*vi*), the first and second bosses 84*p* and 84*q* are arranged to extend in a direction (K2 direction) opposite to the Y direction.

As described above, the cover member 84 also includes the drive-side third supported portion 84*e*, the second longitudinal regulated portion 84*f*, and the spring boss 84*g*. As illustrated in FIG. 1(*i*), the second longitudinal regulated portion 84*f* is a protrusion portion protruding in a protruding direction (X direction) intersecting with the Y direction (normal direction of the flat portion 84*a*). The protruding direction (X direction) of the second longitudinal regulated portion 84*f* intersects with the cut direction (K1 direction) of the first cutaway portion 84*c*.

As illustrated in FIG. 1(*i*), the second cutaway portion 84*d* is arranged between the first cutaway portion 84*c* and the second longitudinal regulated portion 84*f* in the X direction. As illustrated in FIG. 1(*i*) and FIG. 1(*ii*), the first and second bosses 84*p* and 84*q* are arranged upstream of the first cutaway portion 84*c* in the X direction.

Next, a method for attaching the cover member 84 is described with reference to FIGS. 9A and 9B. As illustrated in FIG. 9B, the second idler gear 82 is initially attached to the second boss 84*q* of the cover member 84, and the first idler gear 81 to the first boss 84*p*. Here, the third locking portion 84*p*1 restrains the first idler gear 81 to prevent the first idler gear 81 and the second idler gear 82 sandwiched between the first idle gear 81 and the flat portion 84*a* from coming off the cover member 84 during assembly.

As illustrated in FIG. 9A, the drive-side second supported portion 73*d* is inserted through the hole portion 84*b* of the cover member 84. The contact portions 84*b*1, 84*b*2, and 84*b*3 formed on the rim of the hole portion 84*b* are engaged with the outer peripheral surface 73*d*1 of the drive-side second supported portion 73*d* of the drum bearing member 73, and the rotation regulated hole 84*h* of the cover member 84 is engaged with the rotation regulation boss 71*p* of the cleaning frame 71. In such manner, the cover member 84 is positioned and assembled.

In a state where the cover member 84 is assembled, the first locking portion 84*m* and the second locking portion 84*n* are fitted to a first locking portion 71*m* and a second locking portion 71*n* of the cleaning frame 71, respectively. The cover member 84 is thereby prevented from falling during assembly.

In such a state where the cover member 84 is prevented from falling, the cover member 84 is fixed to one longitudinal end of the cleaning unit 71 by bonding the fixing portion 84*k* with an adhesive and screwing the screw fixing hole 84*i*.

The drum bearing member 73 is sandwiched between the cover member 84 and the cleaning frame 71, whereby its longitudinal position is regulated.

As illustrated in FIG. 10, when viewed in the longitudinal direction, the first cutaway portion 84*c* is cut to be greater than the outer shape of the first longitudinal regulated portion 73*f* of the drum bearing member 73. The first longitudinal regulated portion 73*f* can thus pass through the first cutaway portion 84*c* during the assembly of the cover member 84. This enables the cover member 84 to be attached after the attachment of the drum bearing member 73 to the cleaning frame 71. The assembly steps of the cartridge B can thus be simplified.

As described above, according to an exemplary embodiment of the present invention, a cartridge including a photosensitive drum and a coupling member can be made more developed than heretofore.

Functions, materials, shapes, and relative arrangement of the components described in the present exemplary embodiment are not intended to limit the scope of the aspects of the present invention thereto unless otherwise specified.

While the aspects of the present invention have been described with reference to exemplary embodiments, it is to be understood that the aspects of the invention are not limited to the disclosed exemplary embodiments. The scope of the following claims is to be accorded the broadest interpretation so as to encompass all such modifications and equivalent structures and functions.

This application claims the benefit of Japanese Patent Application No. 2015-203146, filed Oct. 14, 2015, and No. 2016-168586, filed Aug. 30, 2016, which are hereby incorporated by reference herein in their entirety.

What is claimed is:

1. A cartridge attachable to a main body of an apparatus, the cartridge comprising:

a photosensitive drum;

a support frame configured to rotatably support the photosensitive drum;

a coupling member configured to transmit driving force to the photosensitive drum to rotate the photosensitive drum, the coupling member arranged on one end side of the photosensitive drum in a direction of a rotational axis of the photosensitive drum; and a cover member attached to the support frame, wherein the support frame includes an arc portion arranged on one end side, which corresponds to the one end side of the photosensitive drum, of the support frame in the direction of the rotational axis, with a center axis of the arc portion being the rotational axis, and a protrusion portion configured to make contact a guide portion of the main body and be regulated in position in the direction of the rotational axis, the protrusion portion protruding radially outward from an outer peripheral surface of the arc portion, and wherein the cover member includes a flat portion, a substantially circular hole portion formed in the flat portion and having a substantially circular shape viewed in a normal direction of the flat portion, the arc portion being inserted through the hole portion, a first concave portion having a shape concaved outward from the substantially circular hole portion in a radial direction of the substantially circular hole portion, the first concave portion arranged in a position opposed to the protrusion portion when viewed in the direction of the rotational axis, and a second concave portion having a shape concaved from the substantially circular hole portion in the normal direction of the flat portion to expose the coupling member when viewed in a direction orthogonal to the rotational axis.

2. The cartridge according to claim 1, wherein the first concave portion has a concaved shape greater than an outer shape of the protrusion portion when viewed in the normal direction.

3. The cartridge according to claim 1, wherein the cover member includes a first positioned portion configured to make contact with a first positioning portion of the main body in a state in which the cartridge is mounted on the main body, and wherein a position of the support frame in the normal direction is determined by the first positioned portion making contact with the first positioning portion.

4. The cartridge according to claim 1, wherein the arc portion includes a second positioned portion configured to make contact with a second positioning portion of the main body in a state in which the cartridge is mounted on the main body, and wherein a position of the support frame in a direction orthogonal to the normal direction is determined by the second positioned portion making contact with the second positioning portion.

5. The cartridge according to claim 1, wherein the arc portion is configured to accommodate part of the coupling member.

6. The cartridge according to claim 1, wherein the second concave portion is arranged in a position not overlapping with the first concave portion in a circumferential direction of the substantially circular hole portion.

7. The cartridge according to claim 1, further comprising a protrusion portion protruding in a protruding direction intersecting with the normal direction, wherein the protruding direction of the protrusion portion is a direction intersecting with a concaved direction of the first concave portion.

8. The cartridge according to claim 7, wherein the second concave portion is arranged between the first concave portion and the protrusion portion in the protruding direction of the protrusion portion.

9. The cartridge according to claim 8, wherein the flat portion includes a boss extending in a concaved direction of the second concave portion, and wherein the boss is arranged upstream of the first concave portion in the protruding direction of the protrusion portion.

10. The cartridge according to claim 1, wherein the flat portion includes a boss extending in a concaved direction of the second concave portion.

11. The cartridge according to claim 1, wherein the flat portion includes a plurality of bosses extending in a concaved direction of the second concave portion.

12. The cartridge according to claim 1, wherein the cover member includes a gear support shaft configured to rotatably support a gear.

13. A cover member comprising:

a flat portion;

a substantially circular hole portion formed in the flat portion and having a substantially circular shape viewed in a normal direction of the flat portion;

a first concave portion having a shape concaved outward from the substantially circular hole portion in a radial direction of the substantially circular hole portion; and a second concave portion having a shape concaved from the substantially circular hole portion in the normal direction of the flat portion.

14. The cover member according to claim 13, wherein the second concave portion is arranged in a position not overlapping with the first concave portion in a circumferential direction of the substantially circular hole portion.

15. The cover member according to claim 13, further comprising a protrusion portion protruding in a protruding direction intersecting with the normal direction, wherein the protruding direction of the protrusion portion is a direction intersecting with a concaved direction of the first concave portion.

16. The cover member according to claim 15, wherein the second concave portion is arranged between the first concave portion and the protrusion portion in the protruding direction of the protrusion portion.

17. The cover member according to claim 16, wherein the flat portion includes a boss extending in a concaved direction of the second concave portion, and wherein the boss is arranged upstream of the first concave portion in the protruding direction of the protrusion portion.

18. The cover member according to claim 13, wherein the flat portion includes a boss extending in a concaved direction of the second concave portion.

19. The cover member according to claim 13, wherein the flat portion includes a plurality of bosses extending in a concaved direction of the second concave portion.

* * * * *